United States Patent [19]

Miller et al.

[11] Patent Number: 4,924,035

[45] Date of Patent: May 8, 1990

[54] TWIST ON ELECTRICAL CONNECTOR

[75] Inventors: H. Laurie Miller; Donald W. Marr, both of Oakville, Canada

[73] Assignee: Marr Electric Limited, Mississauga, Canada

[21] Appl. No.: 165,913

[22] Filed: Mar. 9, 1988

[51] Int. Cl.[5] ..... H01R 5/12

[52] U.S. Cl. ..... 174/87

[58] Field of Search ..... 174/87; 403/214, 265, 403/268, 270

[56] References Cited

U.S. PATENT DOCUMENTS

| | | | |
|---|---|---|---|
| 2,772,323 | 11/1956 | Smith | 174/87 |
| 3,075,038 | 1/1963 | Schinske | 174/87 |
| 3,297,816 | 1/1967 | Waddington | 174/87 |
| 3,448,223 | 6/1969 | Thorsman | 174/87 |
| 3,483,310 | 12/1969 | Krup | 174/87 |
| 3,716,653 | 2/1973 | Willmarth | 174/87 |
| 3,875,324 | 4/1975 | Waddington et al. | 174/87 |
| 4,112,251 | 9/1978 | Scott | 174/87 |
| 4,150,251 | 4/1979 | Scott | 174/87 |
| 4,220,811 | 9/1980 | Scott | 174/87 |

FOREIGN PATENT DOCUMENTS 1033432 6/1978 Canada .

*Primary Examiner*—Morris H. Nimmo

*Attorney, Agent, or Firm*—Donald E. Hewson

[57] ABSTRACT

A twist on electrical connector is provided, comprising a moulded thermoplastic cap and a wire coil insert therefore. The cap is a thin walled structure, and the coil is in substantially intimate contact along its entire length within the innermost, wire retaining portion, of the cap. A plurality of radially extending ribs, having substantial height and width, is formed on the outer periphery of the cap, at least in the upper portion thereof. The outwardly extending ribs provide a better finger grip, and are generally spaced apart such that the distance between any two adjacent ribs is below the 2-point threshold of discrimination for a human finger. The ribs permit better heat dissipation from the interior of the cap, in the event of heat build up therein; and the generally thin walled construction permits easy injection moulding techniques with relatively quick mould cycle times.

13 Claims, 1 Drawing Sheet

FIG. 1
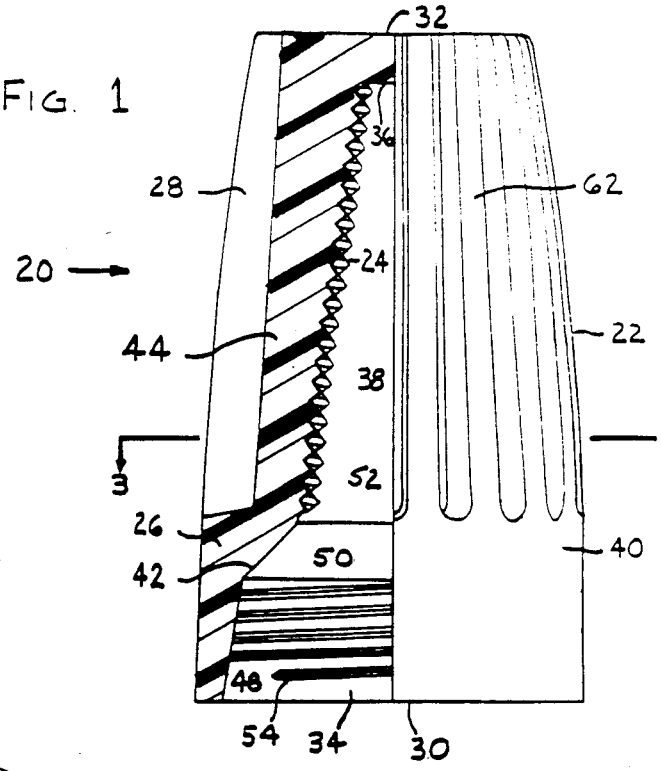
FIG. 2
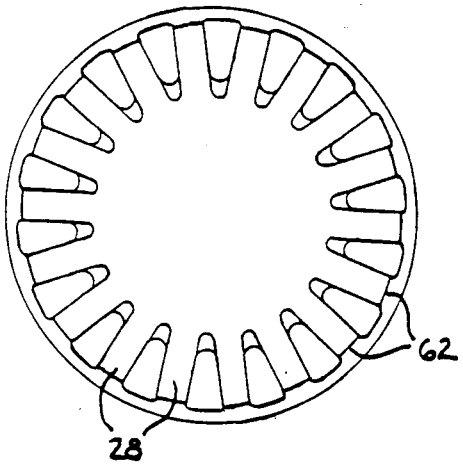
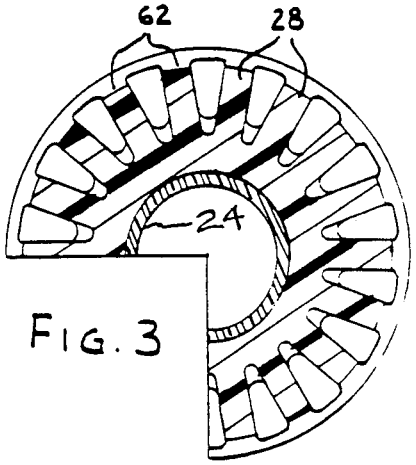
FIG. 3

TWIST ON ELECTRICAL CONNECTOR

FIELD OF THE INVENTION:

This invention relates to twist on wire connectors and the insulating caps that form the outer shell of the connector. More particularly, this invention relates to insulating caps having a relatively thin circumferential wall, and having a configuration that is adapted to resist considerable forces — including especially bursting forces in a radial direction.

BACKGROUND OF THE INVENTION:

It is common in the electrical wiring industry — such as house or industrial wiring and the like — to connect a plurality of wires in electrically conductive relation by using a twist on wire connector. Typically, twist on wire connectors comprise a plastic insulating cap and a coil of wire contained therein. The cap acts as a insulating housing around the coil and also provides a means for gripping the connector in order to twist it onto the wires. The coil comes in contact with the plurality of wires being connected and protects the cap from being damaged by the wires. The gripping forces necessary to retain the wires in electrically conductive relation inside the coil are provided by either the coil or the cap. If the forces are provided by the cap, they are transmitted to the wires through the coil.

Most caps for twist on connectors used in the electrical industry today, are made of thermosetting resin or similar material. Such types of material have a low modulus of elasticity and thus are not easily elastically deformable, together with a high resistance to plastic deformation — desirable characteristics of wire connectors. However, more recently it has become desirable to use thermoplastics, such as nylon, as the material used in the manufacture of connector caps for a variety of reasons, such as cost considerations and colour choice. Thermoplastics, however, are relatively elastic and therefore are easily deformed when tightened onto a pair of wires, generally tending to bulge around the periphery. It is possible to make such caps using an injection moulding process, but a cap configuration not specifically designed to be injection moulded most likely cannot be satisfactorily manufactured in this manner primarily due to cooling considerations.

DESCRIPTION OF THE PRIOR ART:

U.S. Pat. No. 4,150,251 issued Apr. 17, 1979, to SCOTT discloses a screw-on wire connector having a thin wall insulating cap that is made from a variety of plastic insulating materials, including thermoplastic. This type of cap, however, requires a sheet metal retainer to be used in conjunction with it. The bursting forces exerted by the wires being compressed when connected are absorbed by the plastic deformation of the sheet metal retainer. These forces are not transmitted to the insulating cap, thus, the cap does not need to be of substantial strength.

U.S. Pat. No. 4,112,251 issued Sept. 5, 1978, to SCOTT discloses a screw-on wire connector made of a thermoplastic material, and having an expansion coil. The bursting forces exerted by the wires are absorbed by the elastic deformation of the coil. Such expansion does not place bursting forces on the cap since the coil and the cap contact only at the ends of the coil.

Canadian Patent No. 1,033,432 issued June 29, 1978 to NORDEN discloses a screw-on electrical connector made of a deformable insulating material suitable for injection moulding from a wide variety of plastic. The coil inside the connector is a nonexpansion spring, however, and the cap is not relatively thin walled.

SUMMARY OF THE INVENTION:

In order to produce the caps in an economical manner, it is desirable to have them cool as quickly as possible in the injection mould. For this to occur, there must be no large masses of plastic within the cap. It is therefore desirable to design the cap such that it has a relatively thin circumferential wall and that any associated integral portions thereof, such as those used for gripping or guiding the wire into the connector, are also relatively thin.

Most presently available thermoplastic caps are thick walled with either small raised lines for gripping purposes, or are thick walled with a plurality of thick fins for gripping and twisting purposes. The thin walled thermoplastic caps that are available employ an internal expansion coil which applies most of the retaining force used to bind the plurality of wires together. Such coils only contact the plastic connector cap at the ends of the coil and therefore transmit only a small fraction of the bursting forces to the cap. As a result, the cap does not need to be of high strength. The expansion coil, however, does need to be of greater strength and quality, and therefore higher cost, than if it did not need to absorb the bursting forces. It is therefore desirable to design a connector having a plastic cap and coil, wherein the radially directed bursting forces may be transmitted to the cap, thus allowing a less expensive coil to be used. The coil must be in substantially intimate contact along its entire length with the inside of the cap, in order to provide a means for good transmission of forces. The cap must be designed to withstand the bursting forces being transmitted to it, while also being thin walled. This means that the coil must be of substantially equal radius to the inner configuration of the cap, at any point along the length of the coil. One advantage of this configuration of coil is that the inside edge of the coil generally defines a conic section, which is straight walled by definition. This provides for more contact areas between the coil and the wires than does an expansion spring.

It is most often necessary to apply strong gripping forces to the plurality of wires being connected in order that proper electrical connection be made. Proper electrical connection requires a tight physical connection between the wires being connected and between the wires being connected and the conductive coil part of the connector. It is very important that these connections be tight enough that gaps cannot develop between the connecting surfaces. If a gap develops, there may be a possibility that the surfaces at these points will oxidize, and result in connections that are relatively high in resistance. Such high relative resistance connections may produce a great amount of heat while conducting electricity, due to the fact that the power dissipated by the connection is proportional to the resistance and to the square of the current.

When the wires are inserted into the connector and the connector is turned so as to threadibly engage the wires, the edges of a square wire coil will cut into the wires slightly, thus precluding the wires from slipping out of the connector. (A coil formed of round wire may not cut into the wires being connected to the same extent as a properly oriented square wire coil, but that does not suggest that use of coils formed of round wire is in any way precluded.) As the connector is turned, the wires and the connector are drawn inwardly towards one another such that the ends of the wires move towards the distal (closed) end of the connector. As the connector is tightened onto the wires, the wires become pressed tightly together and exert reaction forces, generally referred to as bursting forces. These bursting forces cause the coil to expand slightly, and also to shorten slightly. These forces in turn tend to expand the plastic cap. Even a square wire spring does not cut into the cap by any significant amount because the outer coil surface is in generally intimate contact with the complementary inside threaded surface of the cap. It is important that the coil and cap expand elastically so that continuous gripping forces can be applied to the wires being connected. In the present invention, these forces are supplied to some extent by the plastic cap. In order that the plastic cap be able to withstand the resulting bursting forces without breaking, it is necessary that it have a fairly high strength associated with it.

The present invention provides a cap for a non-expansion coil electrical connector that provides gripping forces for tightly holding wires together in proper mechanical and electrical connection. This is accomplished by having a cap with several deep fins radiating axially from the wall of the connector. The fins are high enough to provide suitable structural strength for the cap by acting as external beams, vertically (or axially) directed on the outer surface of the cap. The fins are also thin enough to help radiate any heat build-up that may occur within the connector. Additionally, it is desirable that the cap have good finger gripping qualities so that it is not necessary to grip the cap overly tightly in order to turn it to the required tightness. This is accomplished by having several fins so disposed such that a plurality of fins would be in contact with the thumb and one or two fingers when twisting the cap. Also, the fins are formed such that the corners are virtually right angled, thus allowing them to slightly thrust into the skin, thereby providing a good gripping means.

The present invention also provides a structure which satisfies the requirements for good moulding techniques, permitting production of the moulded thermoplastic caps in an economical manner, as noted above. The use of generally thin walled sections, not only in the circumferential wall of the cap, but also in respect of the fins extending radially outwardly therefrom, assures relatively even cooling with a short cooling cycle of the moulded part within the mould. This, in turn, precludes moulding deficiency such as sink marks, which could materially affect the electrical and mechanical properties of the cap, as well as make the product less visually acceptable.

BRIEF DESCRIPTION OF THE DRAWINGS:

This invention will now be described in association with the accompanying drawings, in which:

FIG. 1 is a partially cut away side view of a cap containing a coil of wire;

FIG. 2 is a top view of the cap; and

FIG. 3 is a partially cut away sectional view taken along section line 3—3.

DETAILED DESCRIPTION OF THE PREFERRED EMBODIMENTS:

The preferred embodiments of the invention will now be described with reference to FIGS. 1 through 3, which show a wire connector 20 comprising a plastic insulating cap 22 and a wire coil 24 contained therein. The connector 20 is adapted to receive a plurality of wires for mechanical therefore electrical interconnection. A square wire coil, as shown, is used in the preferred embodiment of the invention, because the edge of the coil is adapted to cut into the wires.

The overall shape of the cap 22 is similar to a frustum of a cone. The taper is not straight but is slightly convex. This shape emulates the shape formed by the thumb and two first fingers in a typical gripping configuration. It allows for a better grip while twisting the connector onto (or off, if necessary) a plurality of wires.

The cap 22 consists of a cap body 26 and plurality of ribs 28. The cap 22 has a proximal end 30 and a distal end 32; the proximal end 30 being of a larger diameter and having an opening 34 adapted to receive a plurality of wires; the distal end 32 being of a smaller diameter and having a closed end 36 adapted to preclude the passage of any wires contained in the interior 38 of wire connector 20. The cap body 26 is generally hollow, having an exterior surface 40 and an interior surface 42, and consists of a circumferential wall portion 44 and the closed end 36 of the distal end portion 32. The circumferential wall portion 44 is disposed between the proximal and distal end portions and forms a solid portion therebetween. The circumferential wall portion 44 is relatively thin walled. For example, in a cap having a length of approximately 1.1 inches, and a diameter of approximately 0.0655 inches at the open end 30, the wall thickness nearest the proximal end 30 may be in the order of 0.070 inches, with the wall portion near the distal end 32 being somewhat thicker.

The opening 34 in the proximal end 30 leads into the interior 38 of cap body 22, and is for the purpose of receiving wires therein. The interior surface 42 of the cap body 22 is divided into three portions; a wire receiving portion 48, a channelling portion 50, and a wire retaining portion 52. These three portions are all substantially co-axially aligned, seriatim, within the cap body 26.

The wire receiving portion 48 is tapered slightly inwardly and is adapted to receive a plurality of wires. Contained along a substantial portion of the receiving portion 48 is a threaded portion 54, which exists for the purpose of potentially catching the relatively soft insulation of any wires entering the connector. This potential catching of the insulation can aid in drawing the wires into the interior 38 of the connector 20 as they are twisted relative to one another. Additionally, the wires may be retained better in the connector 20 once they are in place, if portions of the thread 54 have cut into the insulation.

The wire channelling portion 50 is juxtaposed to the wire receiving portion 48, and is sloped fairly severely in order to channel the ends of the wires that have been received into the interior 38 of the connector 20. The wire retaining portion 52 is juxtaposed to the wire receiving portion 50, and is sloped only slightly. The slope is for the purpose of providing progressively more gripping pressure to the plurality of wires being connected, as will be discussed in more detail hereafter. The wire retaining portion holds the wire coil 24, preferably formed of square wire as shown, and is in intimate contact therewith along substantially the entire length of the wire coil 24. In order that forces transmitted between the coil and the cap may be spread over as large an area as possible, the wire receiving portion 50 of the cap 22 is threaded so as to have a surface complementary to the outer surface of the wire coil 24.

The manner in which a plurality of wires is inserted into the connector 20 and subsquently connected mechanically and therefore electrically, will now be described.

The connector is placed over the ends of the wires to be connected, until the wires and the coil 24 contact one another. The connector, which is grasped between the thumb and fingers, is turned in the appropriate direction, generally clockwise when viewed from the distal end of the connector. When the connector is turned, small grooves may be cut into the wires. As the connector is turned further, the wires are drawn further into the connector as the cutting edge of the coil advances in a spiral-like manner along the perimeter of the wires. As the wires advance into the connector, the coil is forced apart slightly because the wires have advanced to a narrower part of the coil. This in turn also tends to expand the plastic cap. As a result, the wires experience the gripping forces of the connector, caused mainly by the resistance to deformation of the cap, thereby keeping the wires positively retained inside the connector. In order for the circumferential wall portion to be strong enough to provide these gripping forces, a plurality of ribs 28 is formed as part of the cap 22. It has been found that from about 14 to about 18 ribs is an optimal number. These radially extending ribs 28 are moulded as an integral part of the cap; in the preferred embodiment, they are at right angles to the circumferential wall portion 44. The ribs 28 extend longitudinally from the distal end portion 32 substantially along the entire length of the circumferential wall portion 44 to the area corresponding to the wire channelling portion 50 on the interior surface 42. The ribs 28 are spaced generally equally around the circumference of the circumferential wall portion 44, with the distance between any two adjacent ribs being below the two-point threshhold for a typical human finger, which is the distance on the skin of a person where pressure that is applied at one point or two points cannot be differentiated and seems as if at one point. This is generally in the order of three to six millimeters. This means that the pressure transmitted to the fingers and thumb is distributed fairly evenly thereto, and there are no small local areas of high force due to a small part of the cap digging into the fingers or thumb. This results in a more comfortable grip for the user.

The perimeter surface 62 of the ribs roughly corresponds to the shape of a convex frustum, as earlier described. The perimeter surface 62 of each rib is substantially flat from side to side and terminates in a substantially 90 degree corner at each side, with both sides of each rib being parallel to one another. These 90 degree corners provide means for obtaining a very good grip on the cap, which means that the gripping forces necessary to turn the connector tightly onto a plurality of wires is less than if the cap did not have such a gripping means.

In addition to being thin, the ribs are also relatively high, for a variety of reasons. Firstly, the circumference of the cap is maximized, which in turns maximizes the moment arm about the centre of rotation of the cap. In order to generate a given amount of turning torque, a smaller turning force is required since the torque is a product of the force and the moment arm. Secondly, the ribs 28 act as heat conductors and radiators by conducting heat away from the cylindrical wall portion 44 and the interior 38 of the connector 20, and radiating it into the surrounding air. The higher the ribs are, the more surface area they will have, which allows for the heat to be radiated at a greater rate. Thirdly, the distance from the top of the ribs to the circumferential wall portion 44 must be deep enough to allow some skin from the fingers and thumb to fall therebetween. This ensures that the aforementioned 90 degree corners can dig as far as possible into the skin in order to provide as good a grip as possible. Finally, these ribs 28 act as beams, which gives added strength to the circumferential wall portion 44 in counteracting the bursting forces of the contained wires. Because the strength of a beam is directly related to its height, these higher ribs will indeed add a great deal of strength to the cylindrical wall portion 44. This is very necessary considering that the cylindrical wall portion is, by nature of the invention, thin walled. Having a fairly large number of ribs spaced around the circumference of the cap means that there is added strength around the entire perimeter of the cap.

In the preferred embodiment the ribs are preferably straight and parallel for aesthetic reasons, and also to allow for removal from the injection mould.

The cap is preferably made of a thermoplastic material such as nylon, polypropylene, polyethylene, copolymers of polypropylene and polyethylene, and talc- or mica-filled polypropylene. These materials lend themselves to being injection moulded, which is a quicker and also less expensive operation than is the thermosetting operation used to mould powdered thermosetting plastics. Additionally, the above mentioned thermoplastics can be made in a variety of colours, which can correspond to different sizes of wire connectors.

After the cap has been injection moulded and cooled, it may be easily stripped off a mould insert. Of course, the threads on the interior of the cap may also be taken advantage of, since they will cause the cap to advance off the mould insert if it is spun in the appropriate direction. In any event after the cap is removed from the mould the complementary wire coil — usually formed of square wire, as noted above — is inserted into the interior of the cap, and abutts against the closed end 36 at the distal end portion 32 of the cap 22.

In an alternative embodiment, the invention presented herein may have angled ribs on the perimeter of the circumferential wall portion instead of ribs that are perpendicular thereto. This would allow the forces that are transmitted through the ribs, which create the turning moment, to be more directly in line with the ribs so that more force could be transmitted through the ribs, or alternatively thinner ribs could be used to transmit the same force.

Other modifications and alterations may be used in the design and manufacture of the twist on electrical connector of the present invention without departing from the spirit and scope of the accompanying claims.

What is claimed is:

1. A molded plastic cap for use in a twist on wire connector that is adapted to connect a plurality of wires in electrically conductive relation, comprising:

a substantially frustum shaped body, said body being generally hollow, and having an interior surface and an exterior surface; and including a proximal end, a distal end, and a circumferential wall portion disposed therebetween forming a solid connection between two said ends, with said proximal end being the larger end of the frustum and said distal end being the smaller end of the frustum; said body having a gripping portion forming a substantial portion of said exterior surface of said body;

wherein said proximal end is open for insertion of wires and said distal end is closed to preclude passage of wires when inserted in said cap;

wherein said circumferential wall portion includes a wire receiving portion, a channelling portion, and a wire retaining portion, all forming part of said interior surface, with all of said included portions being substantially coaxially aligned seriatim within said frustum shaped body;

wherein said wire retaining portion comprises a generally tapered bore hole which is adapted to receive a conductive wire retainer in the form of a coiled spring;

wherein said gripping portion includes a plurality of circumferentially evenly spaced radially outwardly extending ribs around said exterior surface, which ribs extend radially outwardly from said wire retaining portion and substantially along the lengths thereof;

wherein said ribs are generally straight and parallel, and substantially of constant thickness, and said ribs act to provide structural reinforcement to said circumferential wall portion;

wherein the distance between two adjacent ones of said ribs is below the 2-point threshold of discrimination for a human finger; and wherein said circumferential wall portion is generally thin.

2. The molded plastic cap of claim 1, wherein said cap is made of a thermoplastic material.

3. The molded plastic cap of claim 2, wherein said thermoplastic material is a polymeric material selected from the group consisting of nylon, polypropylene, polyethylene, and a copolymer of polypropylene and polyethylene.

4. A twist on electrical connector that is adapted to connect a plurality of wires in electrically conductive relation, comprising a molded plastic cap and a conductive wire retainer; wherein said molded plastic cap has a substantially frustum shaped body, said body being generally hollow, and having an interior surface and an exterior surface; and including a proximal end, a distal end, and a circumferential wall portion disposed therebetween forming a solid connection between two said ends, with said proximal end being the larger end of the frustum and said distal end being the smaller end of the frustum; said body having a gripping portion forming a substantial portion of said exterior surface of said body;

wherein said proximal end is open for insertion of wires and said distal end is closed to preclude passage of wires when inserted in said cap;

wherein said circumferential wall portion includes a wire receiving portion, a channelling portion, and a wire retaining portion, all forming part of said interior surface, with all said included portions being substantially coaxially aligned seriatim within said frustum shaped body;

wherein said wire retaining portion comprises a generally tapered bore hole which is adapted to receive a conductive wire retainer in the form of a coiled spring;

wherein said gripping portion includes a plurality of circumferentially evenly spaced radially outwardly extending ribs around said exterior surface, which ribs extend radially outwardly from said wire retaining portion and substantially along the length thereof;

wherein said ribs are generally straight and parallel, and substantially of constant thickness and said ribs act to provide structural reinforcement to said circumferential wall portion;

wherein the distance between two adjacent ones of said ribs is below the 2-point threshold of discrimination for a human finger.

wherein said circumferential wall portion is generally thin;

and wherein said conductive wire retainer is placed in said wire retaining portion of said cap.

5. The combination of claim 4, wherein said plurality of radially outwardly extending ribs includes at least 12 ribs.

6. The combination of claim 5, wherein said plurality of radially outwardly extending ribs includes at least 18 ribs.

7. The combination of claim 4, wherein the outer edges of said ribs are substantially 90 degree corners.

8. The combination of claim 4, wherein the portion of said exterior surface at the circumference of said connector has the form of a convex curve between the proximal end and the distal end.

9. The combination of claim 4, wherein said ribs extend to said distal end of said body.

10. The combination of claim 4, wherein the thickness of said circumferential wall portion of said wire retaining portion and the height of said ribs are substantially the same at said proximal end of said wire retaining portion.

11. The combination of claim 10, wherein said ribs are of decreasing height along said length, such that the height of said ribs at said distal end of said cap is less than the height of said ribs at said proximal end of said wire retaining portion.

12. The twist on electrical connector of claim 4, wherein said cap is made of a thermoplastic material.

13. The twist on electrical connector of claim 12, wherein said thermoplastic material is a polymeric material selected from the group consisting of nylon, polypropylene, polyethylene, and a copolymer of polypropylene and polyethylene.

* * * * *